United States Patent [19]

Davison

[11] Patent Number: 4,475,457

[45] Date of Patent: Oct. 9, 1984

[54] ROLLER MARKER

[75] Inventor: Charles F. Davison, Downers Grove, Ill.

[73] Assignee: Norwood Marking & Equipment Co., Inc., Downers Grove, Ill.

[21] Appl. No.: 400,097

[22] Filed: Jul. 20, 1982

[51] Int. Cl.[3] ..... B41F 5/04

[52] U.S. Cl. ..... 101/228; 101/219; 101/25

[58] Field of Search ..... 101/228, 248, 219, 76, 101/73, 74, 62, 63, 77, 92, 220, 225, 118, 23, 25, 27; 83/299

[56] References Cited

U.S. PATENT DOCUMENTS

| | | | |
|---|---|---|---|
| 2,163,035 | 6/1939 | Grupe | 101/248 |
| 2,289,394 | 7/1942 | Ungar | 83/299 |
| 2,374,096 | 4/1945 | Heywood et al. | 101/350 X |
| 2,835,195 | 5/1958 | Jackson | 101/219 |
| 3,998,156 | 12/1976 | Zimmer | 101/118 X |
| 4,373,444 | 2/1983 | Cunnington | 101/228 |

FOREIGN PATENT DOCUMENTS

| | | | |
|---|---|---|---|
| 55-865 | 4/1980 | Japan | 101/219 |
| 482010 | 3/1938 | United Kingdom . | |
| 715732 | 9/1954 | United Kingdom | 101/248 |

*Primary Examiner*—Edgar S. Burr
*Assistant Examiner*—Charles A. Pearson
*Attorney, Agent, or Firm*—Hill, Van Santen, Steadman & Simpson

[57] ABSTRACT

A marking machine of the type having a powered rotary marking head provided with heated raised indicia brought sequentially and repeatedly into contact with a pigment source and a linearly moving workpiece to be imprinted by the indicia. The device is provided with a rotary drive train which may be geared to the workpiece drive and is equipped with adjustment mechanisms within the train providing for both rotary angle adjustment of the head with respect to the drive input and rotational speed adjustment varying the rate of rotation during each rotation of the head to adjust to different spacing between imprints while maintaining proper imprint speed.

9 Claims, 9 Drawing Figures

ROLLER MARKER

BACKGROUND OF THE INVENTION

1. Field of the Invention

This invention relates to marking equipment and more particularly to rotary head markers which are power driven.

2. Prior Art

Rotary head markers have been frequently used in industry for imprinting indicia on a workpiece. A common type of rotary marker includes a rotating head which has indicia on the circumference thereof which is alternately brought into contact with an inking roll and the workpiece, the inking roll being positioned parallel to, and angularly displaced from, the workpiece surface. Such imprinters are frequently used in connection with film printing where a roll of film which is later to be used as packaging for a product is unrolled past the marker, positioned either at a separate imprint station where it is re-rolled after being imprinted by the marker or in connection with the packaging or filling machine which is being fed by the film. In such instances it is known to utilize preprinted film where the area to be imprinted by the marker represents only a small portion of the individual film panel with the film comprising a longitudinally extending series of panels with each of the panels forming a face of the eventual package.

In such marking devices, and particularly those marking devices in which the rotary head is power driven as opposed to being driven by contact with the workpiece, it is necessary to align the imprint from the marker head with the area of the panel designated to receive the imprint and further with the spacing between designated areas on adjacent panels. Spacing has frequently been varied through the use of different diameter heads or by the use of drive trains for the rotation of the head which vary the speed of rotation of the head. In the latter instance, however, it is important that when the indicia is in contact with the workpiece that both the indicia and workpiece are moving at an identical rate of speed in order to prevent smearing. It has been suggested to vary the rotation speed of the head so that the speed of rotation of the head varies during each complete revolution of the head whereby at the times when indicia are in contact with the workpiece the head will be rotating at a speed equal to the movement of the film past the rotating head while at times when the indicia are out of contact with the workpiece the head is rotating at a greater or lesser speed producing a difference in movement of the indicia and movement of the film. In this manner, spacing between individual imprints can be varied.

It also has been known to adjust the positioning of the imprint with respect to the individual panels by varying the gearing position between the drive to the film transport mechanism and the drive to the rotating head such that the rotation of the head with respect to the film position can be initially adjustably preset.

Heretofore such adjustment possibilities, however, have involved complex variations in the preset condition of the machinery or in the position of the rotating head on its drive shaft or in the drive train. Such adjustments could not easily be made while the machinery was in operation, and added considerably to the maintanence and initial cost of the imprinter assembly. It would therefore be an advance in the art to provide a simple rotary imprint mechanism capable of on the fly, i.e., while operating, adjustment of both imprint position and successive indicia speed.

SUMMARY OF THE INVENTION

My invention provides a rotary head marker where power for rotation of the head is provided through an input shaft trained directly or indirectly to motive means which in turn is trained directly or indirectly to the film advance mechanism. The input shaft drives a pinion adjustable along the length thereof which in turn is helically geared to an elongated helicle gear body mounted on a second shaft. In this manner movement of the pinion, keyed to its shaft, along the driven helical gear will advance or retard the second shaft with respect to the first shaft. By providing an output from the second shaft to the rotation of the head, advancement of the pinion along the second shaft varies the position of rotation of the head with respect to the input shaft thereby providing for adjustment of the positioning of the imprint on each panel of the film.

Adjustment of the spacing between imprints, such as would be necessitated by varying of panel lengths is provided for, initially, externally of the marker by varying the input speed of the marker with respect to the workpiece advance. However, in varying the input rotation speed, the synchronization between the circumferential rotational speed of the rotary head and the linear advance speed of the film is changed. In order to accommodate this difference in spacing of the imprints and resetting speed differences I provide an eccentric drive connection between the output of the helical driven gear and the rotary head with the degree of eccentricity between a driving shaft of the eccentric and a driven shaft of the eccentric is adjustable. This varies the speed of rotation of the rotary marker head during each revolution (or part revolution) and provides a dwell period during which circumferential rotational speed of the indicia periphery will be matched to the speed of the workpiece during the imprint period when the indicia is in contact with the workpiece. At other angular positions of rotation of the marker head, when the indicia is out of contact with the workpiece, the rotary marker head will move at a different angular advance speed than during the dwell period, thus providing for differences in spacing between panel imprint areas while, however, assuring that smear of the imprint does not occur due to the fact that during imprinting the rotary marker head and workpiece advance speeds will be matched.

Additionally, as an important part of my invention, the inking roll for the rotary imprint head is power driven from the shaft of the rotary marker head whereby the ink roll rotates with the marker head but at a rotation speed different from the marker head. Preferably the inking roller utilized is of the dry pigment type using thermoplastic pigment or pigment carriers which will transfer from the dry inking roll to the indicia face substantially only when the indicia face is heated. In the preferred embodiment, the inking roll lies on one diametrical line of the rotary marker head with a backup roller on the opposite side of the diametrical line such that the rotary marker head is positioned between the inking roll and backup roller. The workpiece is passed across the backup roller and, in the preferred embodiment, the backup roller and/or backup roller shaft is eccentric to allow variations in the spacing between the backup roller and marker head, both for adjustment to varying thicknesses of workpieces and for adjusting tolerances. In addition, the mounting shaft for the backup roller may be angularly adjustable with respect to the marker head.

Further in the preferred embodiment, the marker head may be provided with more than one set of imprinting indicia circumferentially spaced and the drive to the marker head may therefore be provided with a speed reducing drive.

It is therefore the principal object of this invention to provide an improved rotary head imprint marker.

It is yet another primary object of this invention to provide a rotary head marker assembly having means for varying the rotary angular relative position of the drive input to the marker assembly and the marker head and further having adjustable means for varying the speed of rotation of the marker head during each revolution of the marker head.

It is another and more specific object of this invention to provide an improved rotary head marker device comprising a housing having a power driven input shaft and a rotary head carrying output shaft with internal drive train means for varying the relative angular position of the input shaft and output shaft and for varying speed of rotation of the output shaft during each revolution of the output shaft.

It is yet another, and specific object of this invention to provide a rotary head marker device of the type used to imprint identicial indicia in indentical spaced positions repeatedly along the length of a workpiece moving past the marker head, the device including a housing having an input shaft thereto driven in relation to the speed of the workpiece movement past the marker head, the housing having an output shaft therefrom carrying a rotary head marker, means within the housing comprising a power train between the input shaft and the output shaft including first means for varying the rotary angular relationship between the input and output shafts and second means for varying the speed of rotation of the output shaft during each revolution thereof, the marker device further comprising a rotary ink roll positioned to contact the marker head, the ink roll being driven by the output shaft through a slip drive, and an adjustably positionable backup roller on an opposite side of the marker head from the ink roll and diametrically opposed thereto.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

DESCRIPTION OF THE PREFERRED EMBODIMENT

Figure 1:
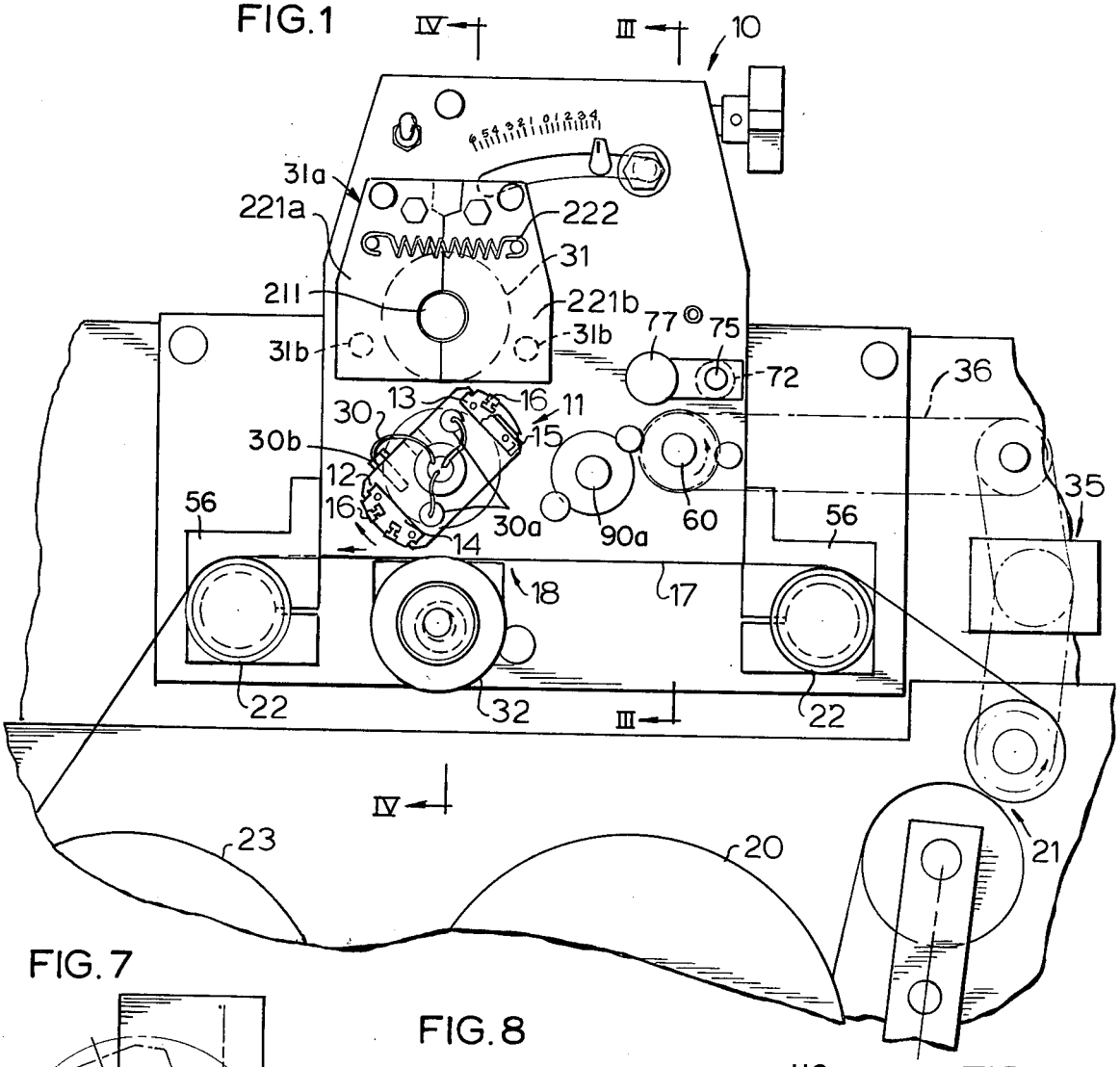
FIG. 1 is a fragmentary front plan view of the marker device of this invention assembled in association with an unwind rewind film assembly.

Referring initially to FIG. 1, there is shown a marker device generally indicated at 10 of the rotary head type employing a rotating head 11 having diammetrically opposed type bar carrying slots 12 and 13 which carry type holders 14 and 15 each of which carries, at a periphery of the rotary head, type bars providing raised indicia 16 for imprinting a workpiece, e.g. a film 17, being moved past an imprint station 18. In the embodiment shown in FIG. 1 the film 17 may be withdrawn from a reel of film 20 and passed through the nip of associated drive pinchrollers 21, and guide rollers 22, and rewound on a rewind reel 23. Alternatively, of course, the marker may be used in connection with production machinery and may, for example, be preferably used in connection with bag forming and filling devices to imprint last minute information such as code dating or pricing information in designated panel areas of pre-printed bag film. The advantage of a rotary head marker in such situations is that the film can be continuously drawn past the imprint station without the necessity of the film being intermittently stopped when the designated area is aligned with the imprint station. Alternatively, since the machine drive is normally utilized as the input drive to the rotary head, intermittent starting and stopping of movement of the film does not preclude proper marking.

In the embodiment illustrated herein, the rotary head 11 is of the heated type and is supplied with electrical power by conduits 30 to cartridge heaters **30*a* controlled by thermocouple 30*b* (in a known manner) to raise the temperature of the indicia 16. Positioned vertically above the rotary head 11 is an inking roller 31 and positioned diammetrically opposed to the inking roll 31, on the other side of the rotary head is a backup roll 32. Although various types of drive devices may be utilized, for the purpose of the showing of FIG. 1, I have shown an input drive assembly 35 common both to the film drive pinch rollers 21 and the chain drive 36 to the marker device 10. Since the drive 35** forms no part of this invention, it will be described only in general.

Because the film 17 normally has preprinted panels, which may differ in size such that imprint areas will differ in spacing, it is normal that if the drive 35 contain a means for varying the speed relationship between the input shaft to the drive and the film transport mechanism such that, for example, if the spacing between imprints in successively used films differs by a factor of 2, then the input speed to the marker device should also be adjustable by a factor of 2 so that when the spacing distance between the imprint area on the film is reduced by ½ the rotational input drive to the marker is increased by 2. Obviously, a greater range of variability is preferred so as to allow for a wide range of different spacings between imprints. In many production machines, it is not necessary to provide a variable drive 35 if the machine has a shaft, for example, a shaft associated with a cut off device, which maintains a constant number of revolutions per panel regardless of panel size. In that case that shaft can be used to drive the machine. The herein described means for varying the rotational speed of the printhead during each revolution of the printhead is therefore desirable because the differing relative speeds of the film transport and marker device which would otherwise produce a difference in speed between the two at the time of print contact. In order to allow the indicia 16 to be brought to the speed of the film passing the imprint station 18 to preclude smearing of the imprint while at the same time rotating the indicia quickly enough to be present at the film contact area when the next imprint panel area is properly positioned, the print head rotational speed is varied during each revolution or part revolution.

Figure 2:
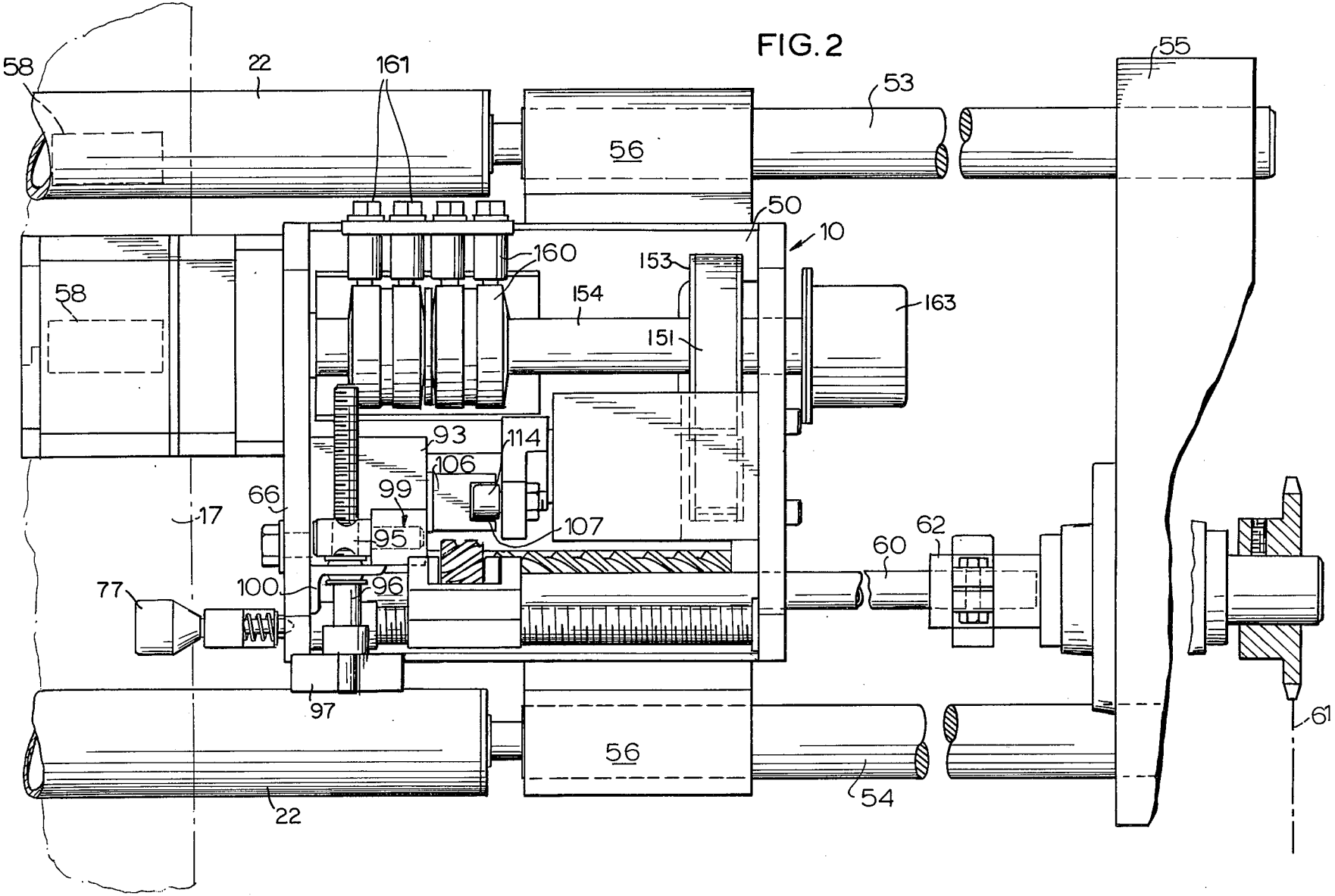
FIG. 2 is a top plan view of the device of FIG. 1 with the cover removed.
Figure 5:
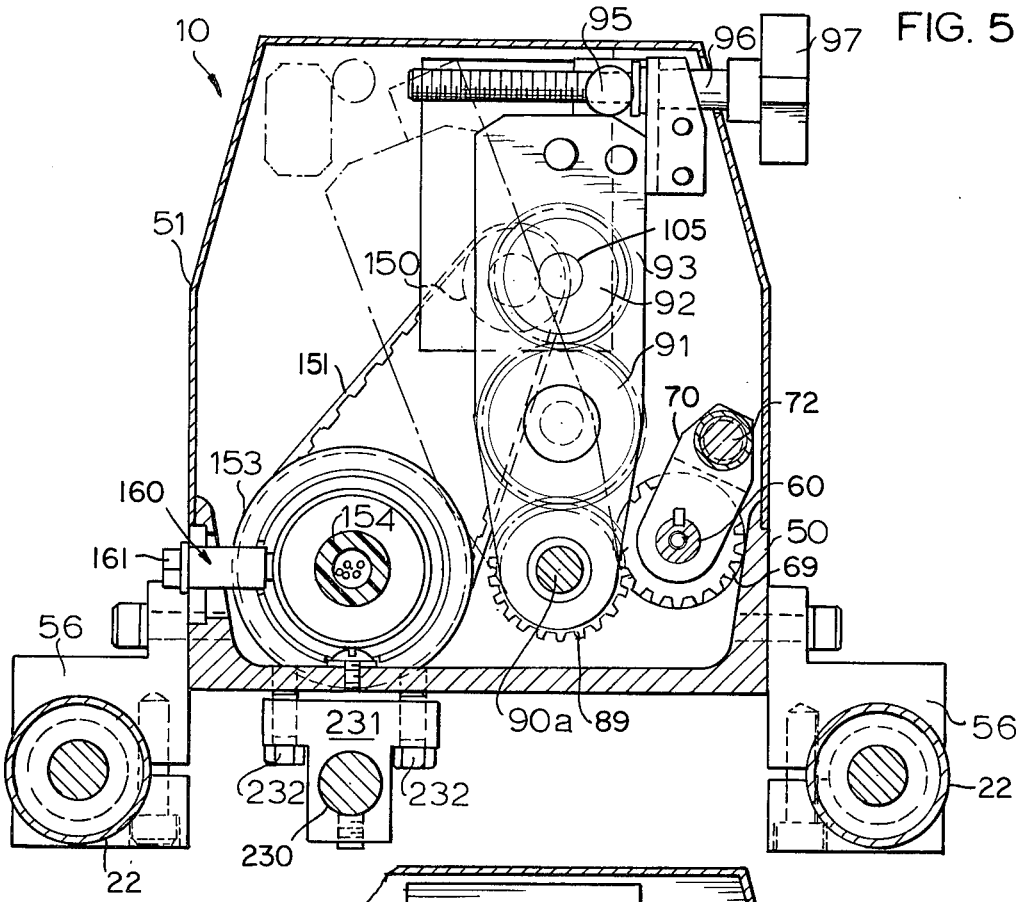
FIG. 5 is a sectional view taken substantially along the line V—V of FIG. 3.
Figure 6:
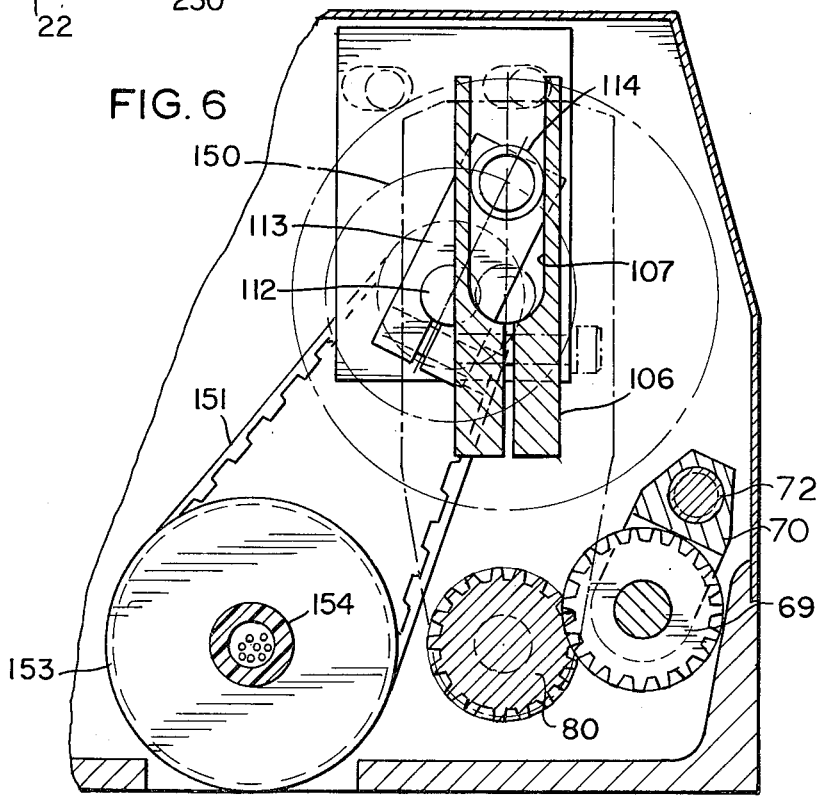
FIG. 6 is a sectional view taken substantially along the lines VI—VI of FIG. 3.

As shown best in FIGS. 2 and 5 the imprint device 10 includes a housing which has a bottom 50 forming a support for the housing which may be closed by cover 51. The housing is supportable on support bars 53 and 54 carried by structure 55 associated with the machine in connection with which the imprint marker 10 is being used. Preferably the base 50 is bolted to support rod clamps 56 in a manner which allows the housing to be moved along the length of the support bars to properly position the imprint station with respect to the film. As shown in FIG. 2 the film has designated spaced imprint panel areas 58 which are spaced from one another along the length of the film.

Figure 3:
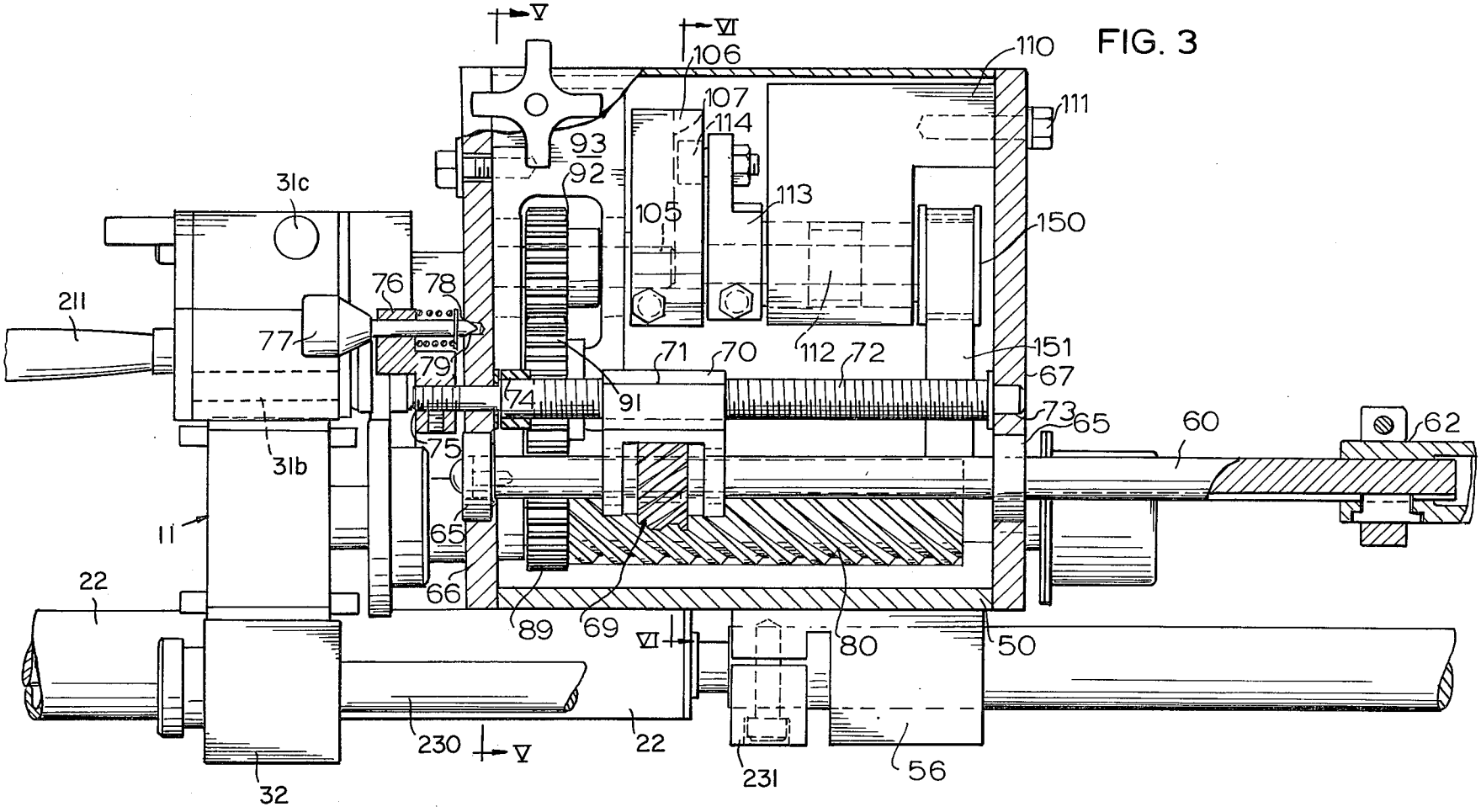
FIG. 3 is a sectional view taken substantially along the line III—III of FIG. 1.

The imprinter housing is provided with an input shaft 60 which may be, for example, chain driven as indicated at 61 and which may further include a slide drive joint 62 to allow positioning of the marker head along the support rods 53 and 54. As shown in FIG. 3, the input shaft 60 is bearing-supported as at 65 in a front wall 66 and back wall 67 of the housing. Interior of the housing a helical geared pinion 69 is longitudinally movably splined to the input shaft 60 and is therefore rotatably driven thereby. The pinion 69 is carried in a pinion clevis 70 which is provided with an internally threaded bore portion 71 carried on threaded bolt 72. Bolt 72 is journalled in the rear wall of the housing 67 at 73 and in journal support 74 at the front wall 66. In addition, bolt 72 has a portion thereof projected through the front wall terminating in an end 75 exterior of the front wall affixed to crank 76. Crank 76 may include spring biased crank handle 77 having a detent assembly 78 for locking the crank handle in position against a detent opening 79 in the outside face of the front wall. It will therefore be appreciated that rotation of crank 76 will move the pinion clevis 70 longitudinally of bolt 72. Pinion 69 is in threaded engagement with a helically geared shaft 80. Due to the provision of the helical gearing, as the pinion clevis is moved longitudinally of the input shaft 60 parallel shaft 80 will be rotated with respect to shaft 60 by an amount determined by the positioning of the pinion clevis such that the relative rotational angular positioning of shaft 60 and shaft 80 are adjustable by movement of pinion 69. Shaft 80, which is also journalled in front and rear walls 66 and 67, has splined at one end thereof first gear 89 which drives a first gear 91 of a pivotable train. As best shown in FIG. 5, the gear train includes gear 89 splined to shaft extension 90*a* at the front end of the shaft 80, idler gear 91 and gear 92. Gears 91 and 92 are carried by shafts which in turn are carried by a support bracket 93 interiorly of the housing. The support bracket is pivotable about shaft extension 90*a*. As shown in FIGS. 2 and 5 bracket 93 has affixed thereto nut 95 at a top thereof. Nut 95 is in threaded engagement with bolt 96 which terminates exterior of the housing in crank handle 97. Rotation of handle 97 and therefore bolt 96 will cause movement of the nut 95 longitudinally of the bolt thereby causing the bracket 93 to be pivoted about shaft 90*a*. Nut 95 is preferably rotatably carried by bracket 93 as indicated at 99 in FIG. 2 and bolt 96 is preferably pivotably carried bv bracket 100 affixed to the inside face of the front wall 66 to thereby accommodate the arcuate movement of the bracket.

As best shown in FIG. 3, gear 92 is splined to shaft 105 journalled in the bracket 93 and projecting therefrom. Shaft 105 therefor arcuately moves within the housing along with the pivoting of the bracket 93. Splined to the shaft 105 is eccentric member 106 having an eccentric groove 107, the eccentric groove projecting radially outwardly from the shaft 105. Groove 107 opens towards the inside face of backwall 67. A stationary support bracket 110 is carried by the backwall 67 as by means such as bolts 111. Bracket 110 has journalled therein an eccentric driven shaft 112 which has affixed thereto and radially projecting therefrom a driven eccentric member 113. Member 113 has cam follower 114 carried thereby with the cam follower being received in groove 106.

In this manner rotation of shaft 105 will cause driven rotation of shaft 112 through the eccentric member 106, cam follower 114 and driven eccentric member 113. Although the driven shaft 112 will be rotated one complete revolution for each revolution of shaft 105, the speed of rotation of shaft 112 will vary throughout each complete rotation by an amount determined by the relative axial misalignment between the shafts.

Figure 7:
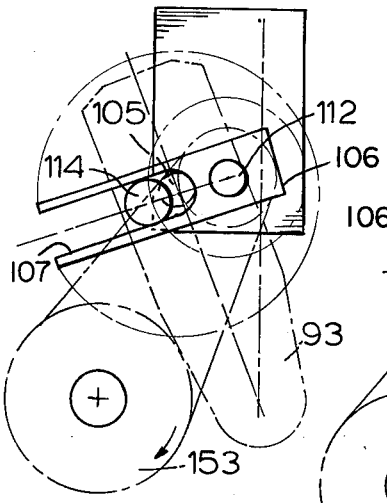
FIGS. 7, 8 and 9, on the first sheet of drawings, are diagrammatic views of the eccentric drive.
Figure 8:
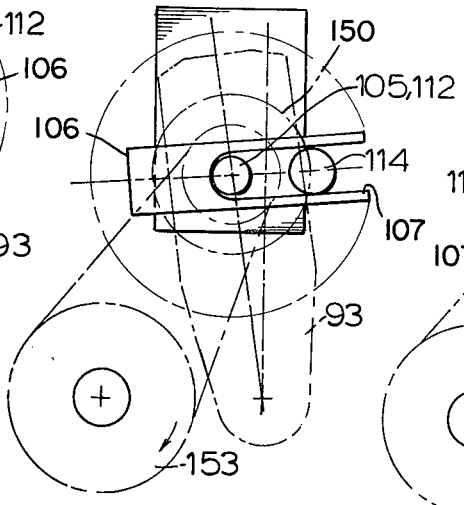
Figure 9:
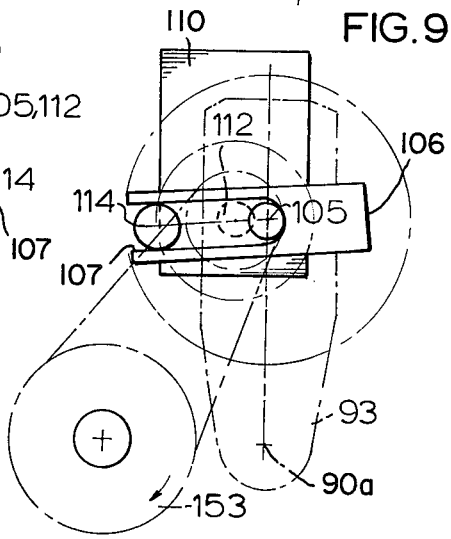

This change in relative rotational speed during each revolution is diagrammatically illustrated in FIGS. 7, 8 and 9 where shaft 105 carried by bracket 93 is shown in FIG. 7 lying to the left of stationary shaft 112 with the positioning of shaft 105 being determined by the relative degree of pivoting of bracket 93. FIG. 8 illustrates the condition with the shafts 105, 112 aligned whereby the speed will be constant throughout the rotation and the shafts 105, 112 will rotate in unison. FIG. 9 illustrates shaft 105 position to the right of shaft 112.

Shaft 112 has an end portion projecting from fixed bracket 110 which carries timing sheave 150 for timing belt 151. As best illustrated in FIG. 5 sheave 150 through timing belt drives sheave 153 affixed to the rotary head shaft or output shaft 154. By varying the size of sheaves of 150 and 153 rotation of the output shaft 154 may be multiplied with respect to rotation of the input shaft 60. In the embodiment illustrated, a 2-to-1 relationship is established so that the marker head 11 which is pinned to shaft 154 rotates at twice the RPM of the input shaft. This is desired because, in the embodiment illustrated, the head 11 is provided with diametrically opposed indicia 16. It will therefore be understood that in this embodiment the variations in rotational speed referred to above during each revolution determined by the eccentric drive actually occur at the marker head as variations during each half revolution.

Figure 4:
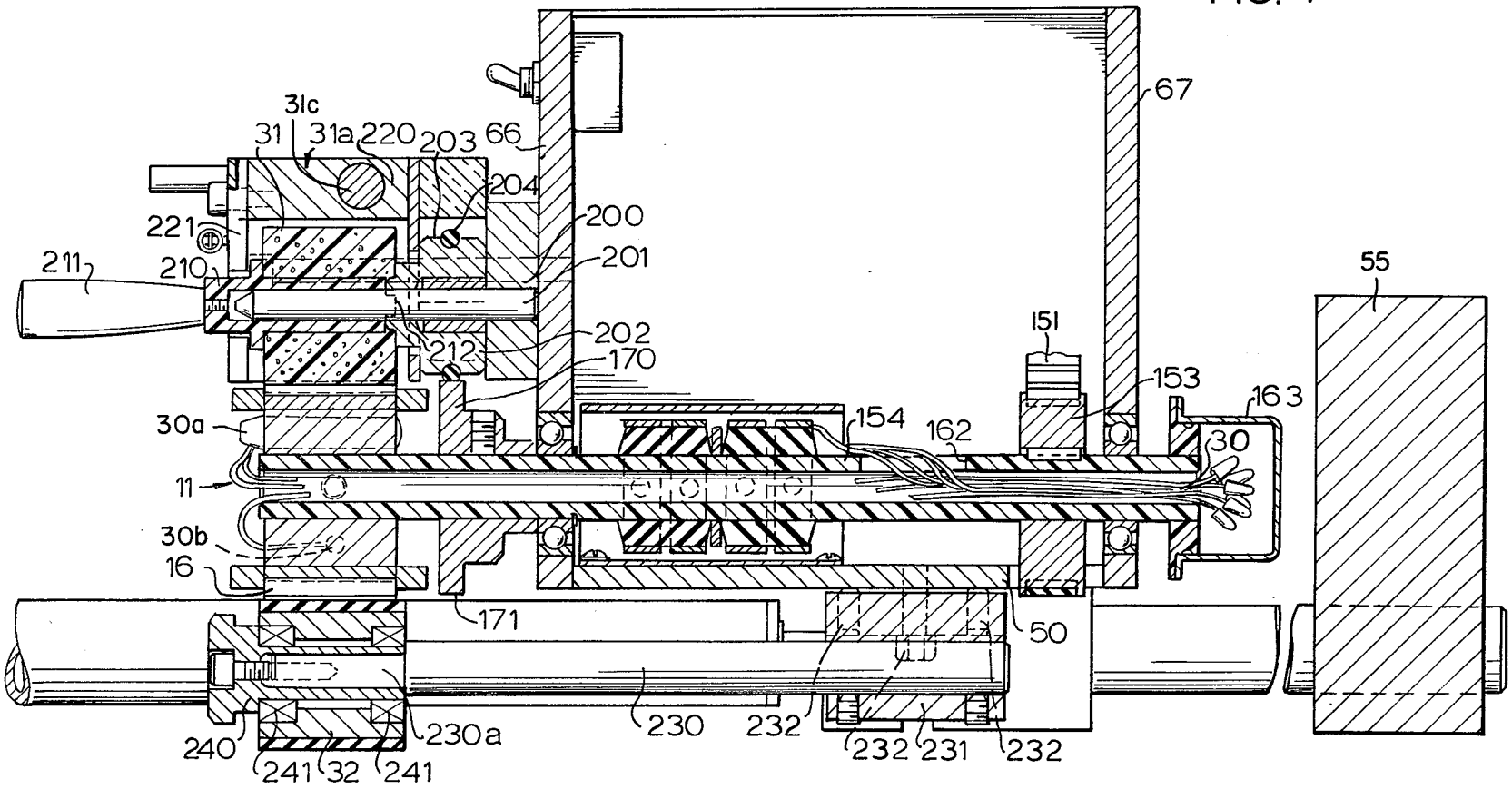
FIG. 4 is a sectional view taken substantially along the line IV—IV of FIG. 1.

Shaft 154 is preferably hollow and has internally thereof the wiring 30 for the heated head 11. In order to provide power to the shaft a rotary slip ring electrical connector assembly 160 (FIG. 2) is affixed externally thereof which is in contact with an electric input source 161. To facilitate maintanence, as is best shown in FIG. 4, the wiring enters the shaft through a radial slot 162 and extends backwardly to a rear projecting closure cap 163 carried by the shaft 154 where connections are made to the wiring extending axially through the shaft to the head 11. The shaft is bearing supported in bearings carried by the front and rear walls 66 and 67 and projects beyond the front wall 66.

As best illustrated in FIG. 4, shaft 154 has affixed thereto exteriorly of the housing a collar member 170 having a cylindrical peripheral surface 171. The collar member is positioned intermediate the front wall 66 and the head 11. Also carried by the front wall 66 above head 11 and immediately above the shaft 154 is the ink roll assembly 31*a*. In the preferred embodiment, the ink roll assembly, which may be heated by means such as cartridge heaters 31*b* controlled by thermostat 31*c*, includes a first mounting member 200 supporting shaft 201. That shaft in turn supports drive collar assembly 202 which is rotatably carried by the shaft 201. The drive collar assembly 202 has an outer peripheral surface 203 having a groove with an O-ring 204 received therein. The O-ring is in engagement with the surface 171 of collar 170 and therefore as the collar 170 is rotated by shaft 154, the drive collar 202 will be rotated, it being understood however, that an O-ring drive is utilized in order to allow slippage between the drive to the ink roller assembly and the drive to the marker head and to provide a resilient drive. The diameters of the collar 170 and drive collar 202 including the perimeter of O-ring 204 may differ so that there will be rotational speed differential in the printhead 11 and the ink roll 31 whereby the type face indicia 16 does not always contact the same area of the ink roll 31.

Ink roll 31 is carried on hollow post 210 which has a handle 211 affixed thereto. The post has an internal diameter dimensioned to be received over the shaft 201 and terminates in a castellated face 212 which meets with a mating castellated end-face on the drive member 203.

The ink roll 31 is preferably of the dry ink type which, when contacted by the heated type face 16, transfers pigment to the type face for impression on the workpiece.

The housing 220 for the roller is preferably closed at its front end by clam shell doors 221*a* and 221*b*, (FIG. 1) which are pivotably carried by the top of the housing 220 and which are held closed by a spring 222. The doors may be of the type that the opening of one door will cause opening of the other door, and the spring 222 is of the overcenter type that will hold the doors open as well as closed. An opening handle 223 may be provided on one or both of the doors.

On the opposite side of the rotary head 11 from the ink roll is a backup roller 32. The backup roller is preferably carried on bar 230 (FIG. 4) which is affixed to the bottom 50 of the housing by bracket 231. Bracket 231 is affixed to the bottom of the housing by bolt means 232 and is equipped with leveling screws 232 to allow pivotal positioning of the bracket 231 with respect to the bottom of the housing so as to change the angulation of projection of rod 230 thereby elevating and depressing the backup roller 32 with respect to the marker head 11. In addition, the backup roller 32 itself is supported on the reduced diameter extension end 230*a* of rod 230 by means of an eccentric 240, the roller itself being supported on the eccentric shaft by bearings 241. In this manner, rotation of the eccentric will provide a fine adjustment elevating and depressing the backup roller while adjustment of the bracket support 231 will assure that the outer periphery face of the backup roller is aligned in a plane with the type face indicia 16 of the marker head 11.

It can therefore be seen from the above that my invention provides a rotary head marker device which includes a housing means within an input shaft thereto and an output shaft therefrom, the output shaft carrying a rotary head marker, an ink roller carried by the output shaft adjacent the rotary head marker and in position to be contacted thereby for inking indicia carried by the rotary head, the housing including first adjustable means for adjusting the relative rotary angular relationship between the input shaft and the output shaft whereby the rotational position of the rotary head with respect to the driving input shaft is adjustable for any position of rotation of the driving input shaft, the housing including second adjustable means for varying the rate of rotation of the rotary marker head during each revolution of the rotary marker head from a constant rate of rotation to a varying rate of rotation.

Although the teachings of my invention have herein been discussed with reference to specific theories and embodiments, it is to be understood that these are by way of illustration only and that others may wish to utilize my invention in different designs or applications.

I claim as my invention:

1. A rotary head imprint marker comprising a housing, an input shaft to said housing, an output shaft from said housing and being parallel to said input shaft, a rotary marker head affixed to said output shaft exterior of said housing for rotation with the output shaft, and said head carrying type means adapted for marking on selected areas at spaced intervals along a traveling workpiece during the rotations of said head, and comprising:

drive train means within said housing between said imput shaft and said output shaft whereby said output shaft is driven by said input shaft, and said drive train means including:

first, adjustable means movable longitudinally along said input shaft for advancing or retarding the relative rotary angular position of the output shaft with respect to said input shaft and thereby effecting corresponding advancing or retarding of said type means and determining the longitudinal locations of the selected areas marked by said type means on the traveling workpiece;

second, selectively presettable means for selectively varying the speed of said output shaft during a portion of each revolution of said output shaft with respect to the speed of revolution of said input shaft, so that the speed of revolution of said head and type means is coordinated with the speed of the traveling workpiece at each marking of said type means on the areas selected by means of said first, adjustable means; and means for drivingly connecting said first, adjustable means with said second, selectively presettable means;

said second, presettable means comprising: means driven by said drivingly connecting means and carried by a movable bracket, said driven means terminating in a first shaft which has a first eccentric drive member affixed thereto, a second shaft, said second shaft being held in fixed rotatable position with respect to said housing and having a second eccentric driven member affixed thereto, a drive connection between said first eccentric drive member and said second eccentric driven member, the position of said first shaft being variable with respect to said second shaft by selective adjustment movement of said bracket.

2. The device of claim 1 wherein the first, adjustable means comprises a driven helical pinion splined to said input shaft and axially movable therealong which meshes with a helical gear shaft whereby axial movement of the pinion along the input shaft relative to the helical gear shaft will vary the rotation angular position between the input shaft and helical gear.

3. The device of claim 2 wherein the pinion is movable along said input shaft by the movement of a pinion clevis, the pinion clevis being in threaded engagement with a bolt means extending parallel to said input shaft, said bolt means including a crank means exterior of said housing for rotation of said bolt means.

4. A rotary head imprint marker according to claim 2, wherein said bracket is pivotally mounted, and said driven means comprises a gear train carried by said bracket and driven by a gear carried by said helical gear shaft.

5. The device of claim 1 including, adjustment means between the bracket and the housing for controlling pivoting movement of the bracket within the housing.

6. The device of claim 5 including speed multiplier means between said second shaft and the output shaft.

7. The device of claim 1 wherein said first, adjustable and said second, presettable means are each provided with adjusting means exterior of said housing for adjusting them from the exterior of the housing, an ink roll rotatably carried by said housing exterior thereof adjacent said rotary marker head in position to be contacted by said type means carried by said rotary marker head, a power drive means between said output shaft and said ink roll, said power drive means driving said ink roll at a rotational speed different than said output shaft, said drive means including a slip drive.

8. The device of claim 7 including a backup roller means carried by said housing exterior thereof adjacent said marker head on the side of said marker head diammetrically opposed to said ink roll, eccentric means associated with said backup roller effective to move said backup roller towards and away from said marker head.

9. The device of claim 8 wherein said backup roller is carried on a roller shaft means, said roller shaft means affixed to said housing by bracket means, said bracket means being adjustable to adjust positioning of said backup roller relative to said marker head.

* * * * *